US006351894B1

(12) United States Patent
Lund et al.

(10) Patent No.: US 6,351,894 B1
(45) Date of Patent: Mar. 5, 2002

(54) CLOTHES DRYER ATTACHMENT FOR DRYING FOOTWEAR

(76) Inventors: Steven M. Lund; Kenneth A. Niemi, both of P. O. Box 1127, Astoria, OR (US) 97103

( * ) Notice: Subject to any disclaimer, the term of this patent is extended or adjusted under 35 U.S.C. 154(b) by 0 days.

(21) Appl. No.: 09/718,199

(22) Filed: Nov. 22, 2000

(51) Int. Cl.[7] ..... F26B 25/00
(52) U.S. Cl. ..... 34/106
(58) Field of Search ..... 34/106, 105, 104, 34/202, 234, 90, 91, 103, 201, 233, 232, 220

(56) References Cited

U.S. PATENT DOCUMENTS 3,154,392 A * 10/1964 Littman ..... 34/104
4,011,662 A * 3/1977 Davis et al. ..... 34/90
4,122,612 A * 10/1978 Mrofchak ..... 34/86
4,158,262 A * 6/1979 Grasso ..... 34/202
5,632,099 A * 5/1997 Seifert et al. ..... 34/106
6,216,359 B1 * 4/2001 Peet ..... 34/105

* cited by examiner

*Primary Examiner*—Teresa Walberg
*Assistant Examiner*—Vinod D. Patel
(74) *Attorney, Agent, or Firm*—James D. Givnan, Jr.

(57) ABSTRACT

An attachment for a clothes dryer includes an air valve with a positionable spherical member for directing heated air to a wall vent or to a flexible conduit serving an article holder for drying various articles. A tee of the holder diverts air into rotationally positionable elbows and air tubes therein. A bracket holds the article holder stowed in compact abutment against a room wall. The holder is also removable from the bracket for floor placement and with the addition of tubular extensions for the drying of large items.

8 Claims, 2 Drawing Sheets

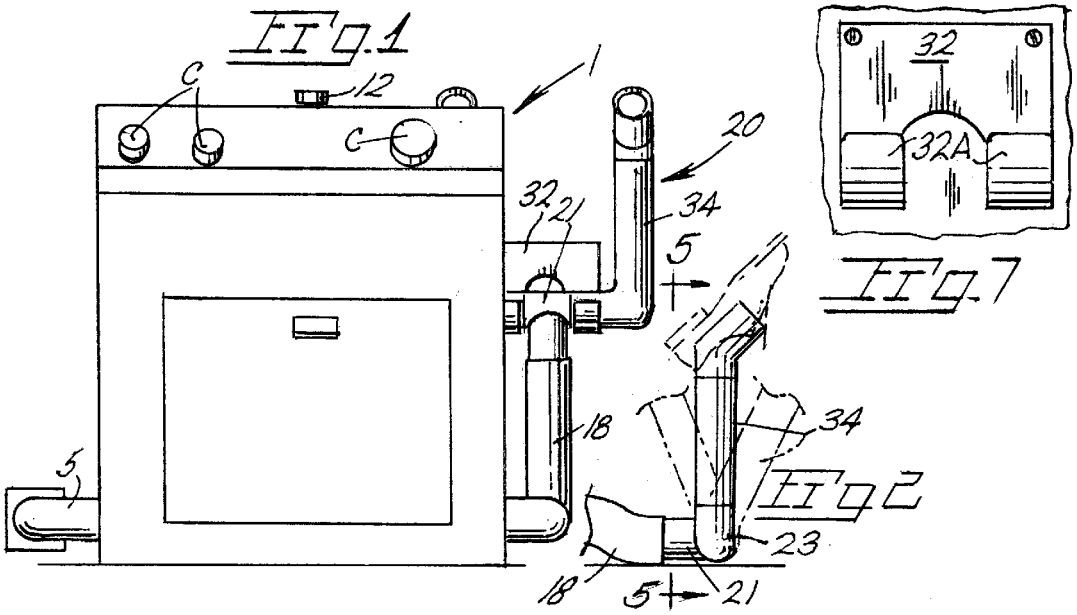
FIG. 1
C
12
C
1
20
32
21
34
5
18
5
34
FIG. 2
23
18
5
21
32
32A
FIG. 7
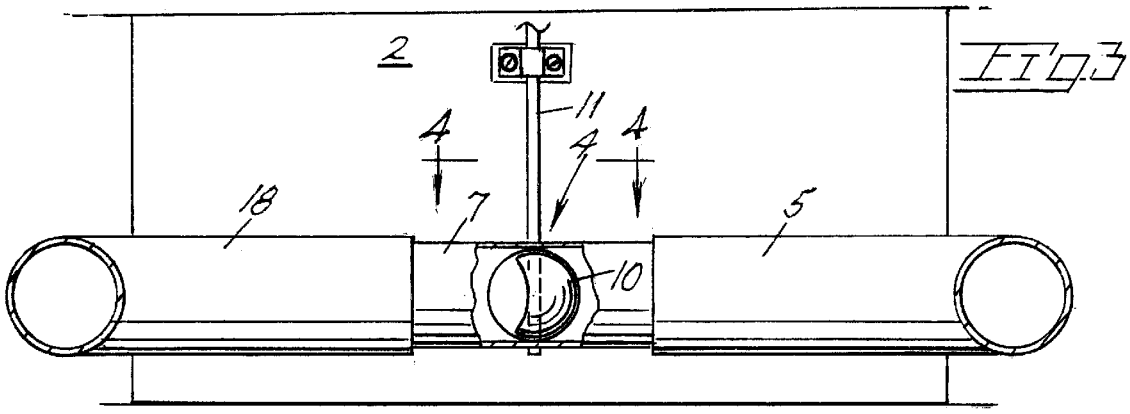
2
11
4
4
4
18
7
5
10
FIG. 3
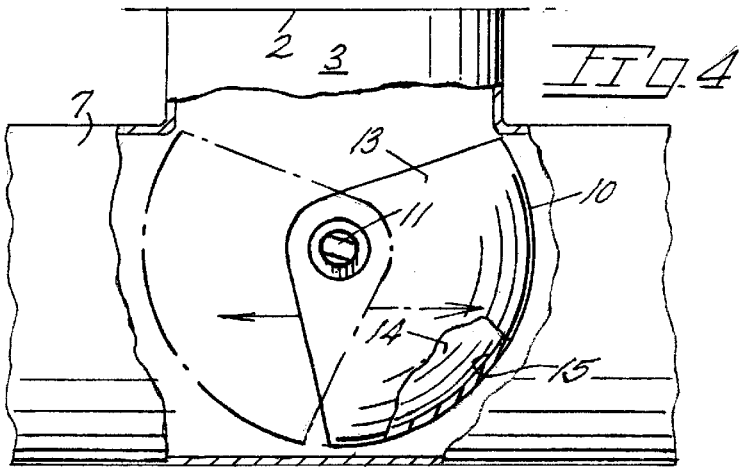
2
3
7
13
11
10
14
15
FIG. 4

CLOTHES DRYER ATTACHMENT FOR DRYING FOOTWEAR

BACKGROUND OF THE INVENTION

The present invention pertains generally to an attachment for a clothes dryer of the type found within the home for the purpose of drying apparel.

Several issued U.S. patents disclose clothes dryer attachments which utilize dryer exhaust flow for the drying of articles supported on air conduits or confined within enclosures served by the dryer exhaust.

U.S. Pat. No. 3,197,886 discloses a garment bag supported on a metal hanger affixed to a clothes dryer with dryer output being directed into a vented clothes bag. A warm air conduit attaches to an opening in the dryer for directing heated air to the clothes bag.

U.S. Pat. No. 3,256,616 discloses a cabinet which seats atop a clothes dryer and is provided with baffles to direct a heated air flow from a dryer exhaust duct through the cabinet and thence to an outlet segment of the exhaust pipe. The cabinet is permanently attached to the dryer outlet conduit and includes a positionable baffle.

U.S. Pat. 3,417,481 discloses a clothes dryer wherein dryer output may be diverted through a garment bag in which the articles to be dried are hung. A valve plate diverts heated air from the dryer outlet conduit to the garment bag.

U.S. Pat. 3,645,009 discloses an attachment to a hair dryer which attachment includes a heated air conduit terminating in a U-shaped boot or glove support structure of a tubular nature and through which heated air from the hair dryer passes for drying of gloves or footwear supported on the structure.

U.S. Pat. 5,222,308 discloses a boot dryer comprising a manifold with multiple U-shaped footwear holders apertured to discharge heated air from a dryer. The U-shaped structures have right angular end segments.

U.S. Pat. 3,154,392 discloses a boot dryer wherein discharge conduits have curved distal ends for discharging heated air to the interior of boots.

SUMMARY OF THE PRESENT INVENTION

The present invention is embodied within a clothes dryer attachment which may remain in place coupled to the clothes dryer with convenient control means enabling standard dryer operation or, alternatively, redirection of dryer air through a support structure for the articles being dried.

The present invention is embodied in a conduit system coupled to a dryer outlet and having a valve for directing the driver outlet flow toward an exhaust vent or toward a wall mounted support assembly on which are the articles to be dried. A valve for directing dryer discharge is shaped to promote a non-turbulent flow of heated air in either direction without presenting surfaces on which fibers or other matter from the discharge flow may collect. A hand control permits the dryer user to position the valve while making other settings on the dryer control panel. The wall supported holder for articles to be directed includes a wall mounted or fastened bracket in which an article holder is stored or may be used for the drying of certain articles while, in other instances, it is removed and located on a floor surface for optimum drying of other types of articles.

Important objectives of the present invention include the provision of an air valve which directs hot air from the dryer to a wall mounted article holder with provision made for relocating the holder onto a room floor for optimum drying of certain articles, as for example hip boots; the provision of conduit system wherein an air valve serves to direct dryer discharge toward a dryer vent for discharge to the atmosphere, or alternatively, toward a wall supported holder for articles not suitable for placement in a clothes dryer, the provision of a dryer attachment with an air valve having a concavo-convex member for directing dryer discharge.

BRIEF DESCRIPTION OF THE DRAWINGS

In the accompanying drawings:

FIG. 1 is a front elevational view of a clothes dryer equipped with the present conduit system for drying articles by heated air from the clothes dryer;

FIG. 2 is a side elevational view of an article holder positioned on a floor surface;

FIG. 3 is a partial rear elevational view of a clothes dryer showing components of the present dryer attachment;

FIG. 4 is a view taken downwardly along line 44 of FIG. 3 and with fragments broken away to show details of an air valve;

FIG. 7 is a front elevational view of a bracket for the article holder.

DETAILED DESCRIPTION OF THE PREFERRED EMBODIMENTS

Figure 5:
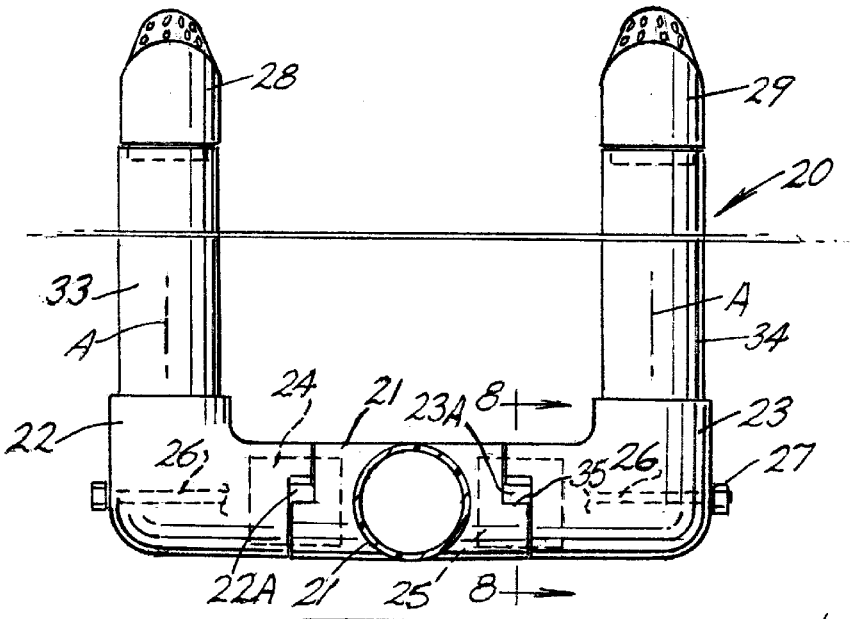
FIG. 5 is a vertical sectional view taken along line 5—5 of FIG. 2
Figure 8:
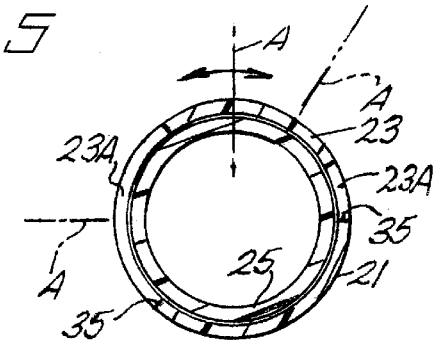
FIG. 8 is a vertical sectional view taken along line 8—8 of FIG. 5.
Figure 6:
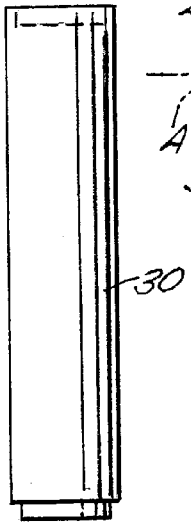
FIG. 6 is a side elevational view of an extension for the article holder.
Figure 9:
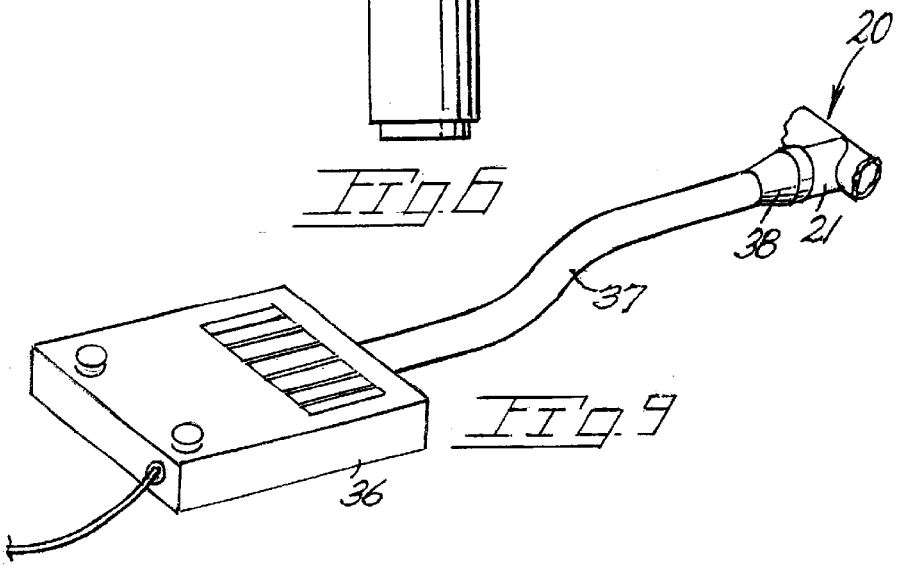
FIG. 9 is a perspective view of a portable heater used as a heat source for the present invention.

With continuing attention to the drawings wherein applied reference numerals indicate parts similarly hereinafter identified, the reference numeral 1 indicates generally a dryer of the type found in the home for the drying of laundry. Dryer controls, as at C, are set to temperatures and durations of operation for the drying of various laundry items.

Adjacent a rear wall 2 of the dryer is an air valve generally at 4 and which receives the dryer heated air flow from dryer outlet 3 in both conventional drying operations as well as when the present attachment is utilized. Swingably mounted within an air valve housing 7 of the present invention is a valve member 10 positionable by a control rod 11 which terminates upwardly in a control 12. Control 12 is located proximate dryer controls C to facilitate convenient setting by the user. Control rod 11 passes through housing 7 and is journaled therein for rotational movement of member 10 about a vertical axis and between the full line and broken line positions shown in FIG. 4. Member 10 as shown is quadrantal in shape with upper and lower wall portions 13 and 14 through which control rod 11 passes with the upper and lower portions affixed to the rod in a suitable manner. Member 10 is preferably of concavo-convex wall surfaces with an inner wall surface 15 spherical to efficiently divert the air flow into conduit 5 or, alternatively, to a flexible conduit 18 which is in discharging communication with an article holder indicated generally at 20. A tee 21 of the holder receives a heated air flow from conduit 18 and serves to divert same into elbows at 22 and 23 (FIG. 5) each having an inlet end rotationally mounted on internal sleeves 24, 25 fixed within tee 21. Elbow retention means may be embodied in a fastener assembly including a threaded shaft 26 with end attached nuts 27 retaining the elbows on sleeves 24, 25 in a rotatable manner. Cut out areas as at 22A–23A of the elbows cooperate with cut out areas of tee 21 defined by tee edges 35 to permit arcuate positioning of the elbows about a horizontal axis. Air tubes 33 and 34, with axes at A, are seated in the elbows and accordingly are adjustable into wall or floor supported positions, the latter when stowed in a bracket 32. Angular nozzles at 28 and 29 are each adjustably seated within the upper end of an air tube.

With attention to FIG. 1, article holder 20 may be stored in a compact manner in wall mounted bracket 32 (FIG. 7) in hooks 32A with air tubes 33, 34 stowed against a room wall. The air tubes may be tipped away from the wall for drying shoes, gloves, headwear, etc. If desired, article holder 20 may be removed from bracket 32 for temporary placement on a floor per, FIG. 2, with tubes 33, 34 tilted somewhat for purposes of stability especially when using extensions as at 30 are in place for the drying of large articles such as hip boots.

While a clothes dryer is shown and described other heat sources may be suitable for use with the present attachment. For example, currently marketed in the U.S. is a small, portable blower 36 for discharging a heated air flow in a flexible conduit 37 into an inflatable pad for placement in a bath tub to aerate the water for therapeutic purposes. As air flow and temperature are variable with such a unit, the unit conduit may be used as a heat source to supply an air flow into article holder 20. If necessary a cone shaped adapter 38 may be utilized to compensate for variance in conduit and tee diameters.

While we have shown but a few embodiments of the invention, it will be apparent to those skilled in the art that the invention may be embodied still otherwise without departing from the spirit and scope of the claimed invention.

Having thus described the invention, what is desired to be secured by a Letters Patent is:

1. In combination, a source of a heated air flow having a discharge outlet, an air valve in communication with said outlet and having a control, and a member having a concave surface against which the heated air flow impinges, a flexible conduit in receiving communication with said air valve, an article support on which articles to be dried are placed and including a tee, elbows each in endwise rotatable engagement with the tee, air tubes one each carried by each of said elbows, means for rotatably positioning of the elbows and said tubes for a drying operation, and a bracket on which said article support may be placed for storage or a drying operation.

2. The combination claimed in claim 1 wherein said member is of spherical shape.

3. The combination claimed in claim 1 wherein said member is quadramental.

4. The combination claimed in claim 1 wherein said article support includes retention means for confining said elbows in frictional engagement with said tee.

5. The combination claimed in claim 4 wherein said elbows and said tee define cut-out areas to limit rotational movement therebetween and hence the positioning of the air tubes into operable and stowed positions, said bracket including fasteners for wall attachment.

6. In combination with a source of heated air flow having a discharge outlet, the improvement comprising, an article support on which articles to be dried are placed and including a tee in communication with the source for heated air, elbows each in endwise rotatable engagement with the tee, air tubes one each carried by each of said elbows, means for rotatably supporting said elbows and said tubes for travel about a horizontal axis for reception of articles to be dried; and a bracket on which said article support may be placed for storage or for a drying operation.

7. The improvement claimed in claim 6 wherein said article support additionally includes retention means for confining said elbows in frictional engagement with said tee.

8. The improvement claimed in claim 7 wherein said elbows and said tee define cooperating cut-out areas to limit rotational movement therebetween and hence permit positioning of the air tubes into operable and stowed positions.

* * * * *